US008881331B2

(12) United States Patent
Gibis et al.

(10) Patent No.: US 8,881,331 B2
(45) Date of Patent: Nov. 11, 2014

(54) HEAD FOR A MOP

(75) Inventors: Karl-Ludwig Gibis, Limburgerhof (DE); Lars Schmitt, Viernheim (DE); Marc Hunger, Viernheim (DE)

(73) Assignee: Carl Freudenberg KG, Weinheim (DE)

( * ) Notice: Subject to any disclaimer, the term of this patent is extended or adjusted under 35 U.S.C. 154(b) by 906 days.

(21) Appl. No.: 12/995,528

(22) PCT Filed: May 29, 2009

(86) PCT No.: PCT/EP2009/003841
§ 371 (c)(1),
(2), (4) Date: Mar. 22, 2011

(87) PCT Pub. No.: WO2009/146847
PCT Pub. Date: Dec. 10, 2009

(65) Prior Publication Data

US 2014/0000053 A1 Jan. 2, 2014

(30) Foreign Application Priority Data

Jun. 2, 2008 (DE) ..... 10 2008 026 254

(51) Int. Cl.
*A47L 13/20* (2006.01)

(52) U.S. Cl.
USPC ..... 15/118; 15/229.2

(58) Field of Classification Search
USPC ..... 15/118, 228, 229.1–229.9
See application file for complete search history.

(56) References Cited

U.S. PATENT DOCUMENTS

| | | | | | |
|---|---|---|---|---|---|
| 1,643,878 | A * | 9/1927 | Crouch | 15/228 |
| 3,205,519 | A * | 9/1965 | Nowlin et al. | 15/118 |
| 3,246,356 | A | 4/1966 | Sorrells | |
| 3,501,796 | A * | 3/1970 | Moss | 15/118 |
| 4,675,932 | A * | 6/1987 | Hofacker, Jr. | 15/118 |
| 4,964,186 | A | 10/1990 | Stuck | |
| 4,989,289 | A | 2/1991 | Bargellini | |
| 6,253,408 | B1 | 7/2001 | Feld et al. | |
| 6,543,082 | B2 * | 4/2003 | Dingert et al. | 15/147.1 |
| 7,624,468 | B2 | 12/2009 | Reddy et al. | |
| 2008/0016640 | A1 * | 1/2008 | Reddy et al. | 15/228 |

FOREIGN PATENT DOCUMENTS

| | | | |
|---|---|---|---|
| DE | 19833553 | C1 | 12/1999 |
| DE | 102004037275 | A1 | 3/2006 |
| DE | 102006007885 | B3 | 3/2007 |
| DE | 102006011368 | A1 | 9/2007 |
| EP | 0259279 | A2 | 3/1988 |
| ES | 1047176 | U | 3/2001 |
| JP | 2000-254060 | * | 9/2000 |
| WO | WO 96/14170 | A | 5/1996 |
| WO | WO 2008/010106 | A | 1/2008 |

* cited by examiner

*Primary Examiner* — Mark Spisich
(74) *Attorney, Agent, or Firm* — Leydig, Voit & Mayer, Ltd.

(57) ABSTRACT

Head (1) for a mop (2), comprising a carrying body (4) which can be connected to a handle (3) and on which are fastened cleaning strips (5) made of textile material, and also comprising an abrasive body (6), wherein the abrasive body (6) is connected with adhering action to at least one cleaning strip (5).

13 Claims, 3 Drawing Sheets

HEAD FOR A MOP

FIELD OF THE INVENTION

The invention concerns a head for a mop, comprising a carrying body, which can be connected with a handle, on which cleaning strips made of textile material are affixed and further comprising an abrasive body.

BACKGROUND OF THE INVENTION

A head for a mop is disclosed in ES 1047176 U. For the assembly of a mop head, several cleaning strips are placed one over the other, twisted with respect to each other and then affixed to the mop head. The cleaning strips are distributed over the circumference on the finished mop head and they hang from the mop head in the shape of a bell. The cleaning strips can be made of various textile materials. For example, the use of microfibers or nonwovens fixed by a binder as a textile material is known. The textile materials are suitable for absorbing water and also grease and for binding particles. Furthermore, the affixing of an abrasive body to the mop head is known. It can be found between the mop head and the cleaning strips or below the cleaning strips. If the abrasive body is below the cleaning strips, it can be difficult to bring it into contact with the floor to be cleaned since it is mostly covered by cleaning strips. If the abrasive body is located between the mop head and the cleaning strips, it sticks out mostly radially from the mop head and in this way it also can be difficult to bring into contact with the floor to be cleaned and only provides a small contact area.

BRIEF DESCRIPTION OF THE INVENTION

An object of the invention is to provide a mop that provides an improved cleaning effect with respect to firmly adhered dirt.

To this end, an abrasive body is provided that adheres with at least one cleaning strip. The abrasive body is cemented on the cleaning strips, adapted to the course of the cleaning strip, and hangs down with the cleaning strip from the mop head. In this way, the abrasive body can be brought into contact simply and with a large contact area, with the floor to be cleaned. Moreover, the cleaning effect is improved with respect to firmly adhering dirt. The abrasive body according to the invention can be a separately produced body and can be made of abrasive materials, such as those used, for example, in scouring sponges. The separately produced abrasive body is affixed on a cleaning strip. Preferably, the abrasive body is placed on the cleaning strip closest to the mop head, so that the abrasive head is located between the mop head and the cleaning strips. With such an arrangement, the handle need not be conducted either vertically nor greatly inclined to bring the abrasive body into contact with the floor to be cleaned. The abrasive body engages with the floor with a slight inclination of the handle. Cleaning with a slightly inclined handle is particularly ergonomic.

The abrasive body can be designed in the shape of a U. The base of the abrasive body can be placed firmly below the mop head, and the two legs lie free on both sides of the mop head and hang down and can be brought into contact with the floor to be cleaned in a particularly simple manner.

The abrasive body can contain polyacrylate fibers or polyurethane foam. If the abrasive body consists of polyacrylate fibers, then they are preferably applied using a solution-containing polyacrylate, for example, sprayed on and fixed there. An abrasive body made of polyurethane foam can also be provided with abrasive polyurethane particles. Combinations of the aforementioned materials are also conceivable. Other conceivable components of the abrasive body are mineral and/or organic additives. As mineral abrasive agents, one can, for example, use quartz, aluminum oxide, silicon carbide, chalk, or glass granules. Mineral abrasive agents are very durable and low-cost. Mineral abrasive agents have a high degree of hardness and therefore have a scratching scouring effect. Mineral abrasive agents are thus used, in particular, for the removal of very firmly adhered dirt. Non-mineral or organic abrasive agents are, for example, polyurethane, PMMA, or nutshells. Non-mineral or organic abrasive agents are simple to process and are also low-cost. The non-mineral or organic abrasive agents have a lower degree of hardness than the mineral abrasive agents. Therefore, these abrasive agents have a non-scratching scouring effect and are particularly suitable for the cleaning of sensitive surfaces. The surface coating can also have polishing particles. The polishing particles can, for example, be formed by siliceous earth. The polishing particles provide an abrasive body with only a slight abrasive effect.

The abrasive body can be secured on the at least one cleaning strip with an adhesive agent. The adhesive agent produces a firm and material-locking connection of the abrasive body and the cleaning strips. The adhesive agent can be so designed that it supports the shaping of the abrasive body, for example, it can be designed to stiffen the abrasive body after hardening.

The adhesive agent can contain a low-melting plastic. Such an adhesive agent can be a low-melting polyethylene. This adhesive agent is placed at least on the cleaning strip or the abrasive body. After the positioning of the adhesive body on the cleaning strip, the parts are heated, optionally pressed together, and in this way, connected with one another, with a material-locking effect. In this process, a U-shape can be pressed on the cleaning body and the cleaning strip affixed to it, so that the abrasive body is dimensionally stable and always hangs down from the mop head, and can be brought into contact with the floor to be cleaned, in a particularly simple manner.

The mop head can include cleaning strips from various textile materials, which are preferably nonwoven materials. Nonwovens have a high specific surface area and exhibit a good cleaning performance. Moreover, the textile material can comprise brushed wool material, a latex-bound nonwoven, or microfibers. The brushed wool material produces an improvement with regard to the breaking up and the subsequent transporting away of dirt. The specific surface is enlarged by the fluffiness, and enhances the absorption of dirt and/or moisture from the surface to be cleaned.

The bound nonwoven can comprise cellulose and synthetic fibers with latex as a binder. Other plastics, for example NBR, are also conceivable as a binder. Such nonwovens exhibit a high water absorption capacity. Microfibers which can be laminated on the cleaning strips of a nonwoven material exhibit a good cleaning effect with respect to grease-containing dirt.

The mop head can have a lemon-shaped basic form, comprising two areas with a small radius and two other areas with a large radius. With such a form, two tapering corners result and two slightly rounded side areas. The tapering corners improve the cleaning performance of the mop, in particular, in corners and on edges.

With this configuration, the abrasive body can be assigned to the area with a small radius. The greatest wiping performance is produced when wiping via the other areas with the large radius, since, here, more cleaning strips can be pressed on the surface to be cleaned by the mop head, than when wiping via the area with small radius. On the other hand, the surface pressing is greater when cleaning via the area with the small radius, so that in connection with the abrasive body, a particularly good cleaning performance is produced with respect to firmly adhered dirt. With the mop head designed in this way, therefore, an improved cleaning performance results with respect to adhered dirt with a simultaneously high surface performance.

BRIEF DESCRIPTION OF THE DRAWINGS

Exemplary embodiments of the mop head, in accordance with the invention, are explained in more detail below with the aid of the figures. The drawings show the following, schematically.

DETAILED DESCRIPTION OF THE INVENTION

Figure 1:
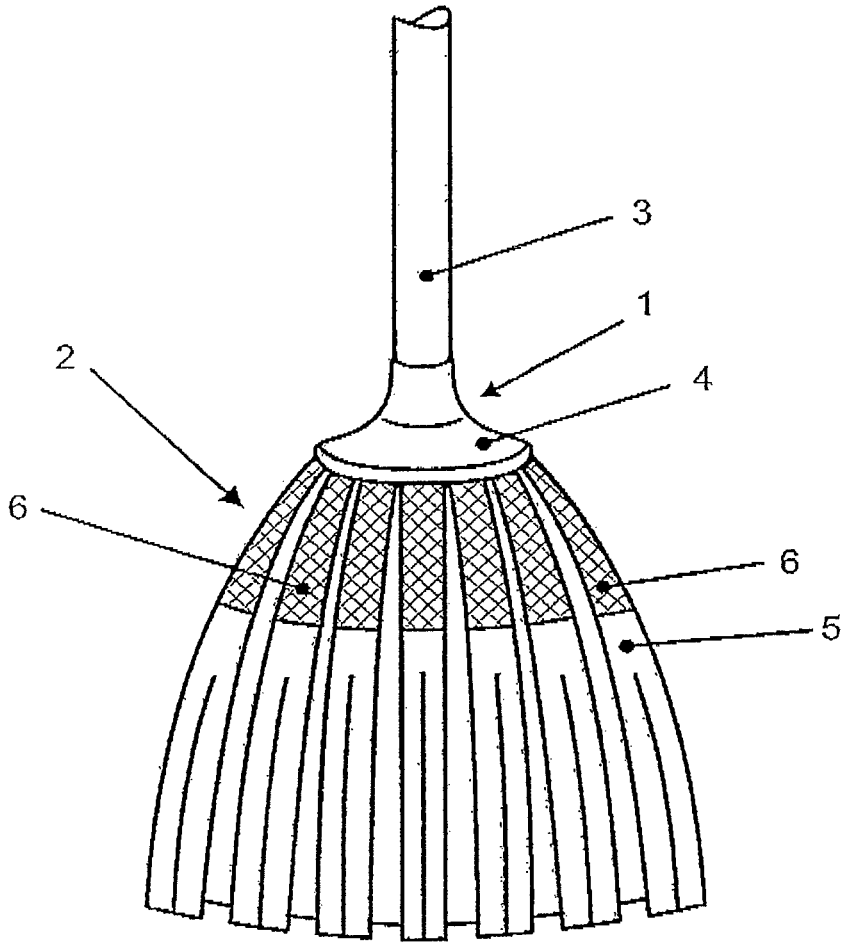
FIG. 1 is a side view of an illustrative mop head according to the invention.

FIG. 1 shows a mop 2 with a mop head 1, which is connected, in a detachable manner, with a mop handle 3 via a plug connection. The mop head 1 comprises a carrying body 4, on which cleaning strips 5 made of textile material and an abrasive body 6 are affixed. The abrasive body 6 is connected so that it adheres with at least one cleaning strip 5. The separately produced abrasive body 6 comprises polyacrylate fibers and is designed so it has a U shape. The abrasive body 6 is connected with a cleaning strip 5, with material-locking effect, using an adhesive agent. The mop head 1 can comprise cleaning strips 5 made of various textile materials. In this development, cleaning strips 5 are made from a binder-fixed nonwoven, wherein microfibers are laminated on some of the cleaning strips 5. A brushed wool material is placed on some of the other cleaning strips 5.

Figure 2:
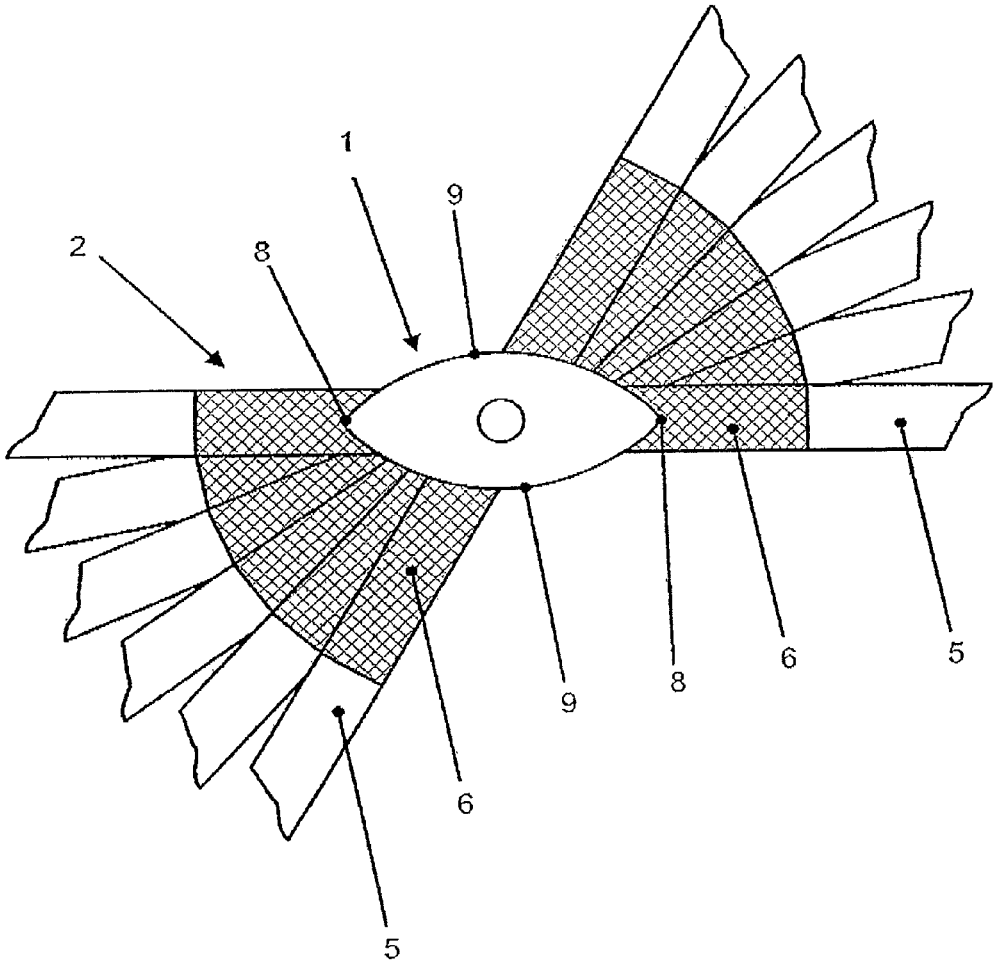
FIG. 2 is a top view of the mop head of FIG. 1.

FIG. 2 shows the mop 2 in top view. One can see that the mop head 1 has a lemon-shaped basic form, comprising two areas 8 with a small radius and two other areas 9 with a large radius. The abrasive body 6 is assigned to the two areas 8 with a small radius.

Figure 3:
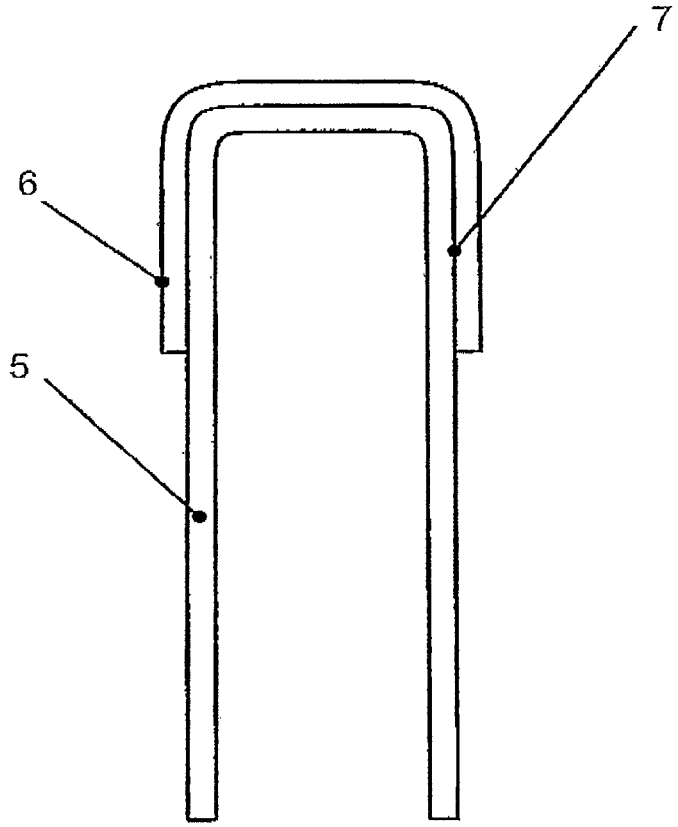
FIG. 3 is side view of an exemplary cleaning strip with an abrasive body.

FIG. 3 shows a cleaning strip 5 for the previously described mop 2. The abrasive body 6 is secured on the cleaning strip 5, using an adhesive agent 7. The adhesive agent 7 is a low-melting plastic-containing polyethylene. To make the bond, the adhesive agent 7 is heated, and the adhesive body 5 is laminated on the cleaning strip 5. Subsequently, with the effect of heat, a shaping takes place, by means of which the abrasive body 5 receives its U shape.

The invention claimed is:

1. A mop head for a mop, comprising:

a carrying body that is connectable with a handle, cleaning strips made of textile material affixed to the carrying body, and an abrasive body that is adhered to one of the cleaning strips by a hardened adhesive agent that is configured to lock a shape of the abrasive body into a U-shape.

2. A mop head according to claim 1, wherein the abrasive body contains polyacrylate fibers.

3. A mop head according to claim 1, wherein the adhesive agent contains a low-melting plastic.

4. A mop head according to claim 1, wherein the mop head contains cleaning strips made from different textile materials.

5. A mop head according to claim 1, wherein the textile material comprises brushed wool material, a latex-bound nonwoven, or microfibers.

6. A mop head according to claim 1, wherein the carrying body has a lemon-shaped basic form, comprising two areas with a small radius and two other areas with a large radius.

7. A mop head according to claim 6, wherein the abrasive body is assigned to one of the areas with a small radius.

8. A mop head according to claim 1, wherein the abrasive body contains polyurethane foam.

9. A mop head according to claim 1, wherein the textile material comprises a latex-bound nonwoven.

10. A mop head according to claim 1, wherein the textile material comprises microfibers.

11. A mop head according to claim 1, wherein the abrasive body contains polyurethane foam.

12. A mop head for a mop, comprising:

a carrying body that is connectable with a handle;

a plurality of textile cleaning strips, each textile cleaning strip affixed to the carrying body at generally a middle portion thereof; and at least one abrasive body adhered to an upper surface of a respective one of the cleaning strips, the abrasive body extending to both sides of the middle portion of the strips;

wherein the at least one abrasive body is secured on the respective one of the cleaning strips using an adhesive agent configured to shape the abrasive body into a substantially U-shape.

13. A mop head for a mop, comprising:

a carrying body that is connectable with a handle, said carrying body having a lemon-shaped basic form comprising two areas with a small radius and two areas with a large radius;

a plurality of textile strips affixed to the carrying body at generally a middle portion thereof, the plurality of textile strips including at least one textile strip attached to the carrying body such that the at least one textile strip passes through the areas with a small radius of the mop head; and an abrasive body adhered to an upper surface of the at least one textile strip, the abrasive body extending to both sides of the middle portion of the at least one strip;

wherein the abrasive body is adhered to the at least one textile strip using an adhesive agent, the adhesive agent providing a firm and material-locking connection between the abrasive body and the at least one textile strip, the adhesive agent being configured to support a shaping of the abrasive body into a substantially U-form.

* * * * *